US011268664B2

(12) United States Patent
Pugh, II et al.

(10) Patent No.: US 11,268,664 B2
(45) Date of Patent: Mar. 8, 2022

(54) ROTATING AND REMOVABLE LIGHT BAR AND CASE FOR TRANSPORT/STORAGE OF THE SAME

(71) Applicant: APEX BRANDS, INC., Apex, NC (US)

(72) Inventors: William E. Pugh, II, Towson, MD (US); Chad Aaron Miley, Camden, OH (US); Russell J. Bohart, Baltimore, MD (US); Eric Jon Van Fossen, Huntersville, NC (US); Brandon Rowlan Stumpf, Parkville, MD (US)

(73) Assignee: Apex Brands, Inc., Apex, NC (US)

( * ) Notice: Subject to any disclaimer, the term of this patent is extended or adjusted under 35 U.S.C. 154(b) by 193 days.

(21) Appl. No.: 16/721,328

(22) Filed: Dec. 19, 2019

(65) Prior Publication Data

US 2020/0200340 A1 Jun. 25, 2020

Related U.S. Application Data

(60) Provisional application No. 62/782,452, filed on Dec. 20, 2018.

(51) Int. Cl.

| | |
|---|---|
| ***F21V 33/00*** | (2006.01) |
| ***F21S 4/28*** | (2016.01) |
| ***F21V 21/096*** | (2006.01) |
| ***B25H 3/00*** | (2006.01) |
| ***F21S 9/02*** | (2006.01) |
| ***F21V 23/04*** | (2006.01) |

(52) U.S. Cl.

CPC ..... *F21S 4/28* (2016.01); *B25H 3/003* (2013.01); *F21S 9/02* (2013.01); *F21V 21/096* (2013.01); *F21V 23/04* (2013.01); *F21V 33/0084* (2013.01)

(58) Field of Classification Search

CPC ..... F21V 33/0084
USPC ..... 362/154
See application file for complete search history.

(56) References Cited

U.S. PATENT DOCUMENTS 4,754,376 A * 6/1988 Winslow ..... F21S 9/02 362/154

* cited by examiner

*Primary Examiner* — Sean P Gramling
(74) *Attorney, Agent, or Firm* — Burr & Forman, LLP

(57) ABSTRACT

A light bar may include a body, a battery housed inside the body, a lighting element housed inside the body, a switch operably coupled to the lighting element and the battery to enable control of lighting intensity of the lighting element based on a position of the switch, a first fixing assembly formed at opposing longitudinal ends of the body, and a second fixing assembly. The first fixing assembly may be configured to enable the light bar to be removable and rotatable relative to a case. The second fixing assembly may be disposed at a portion of the body that is between the opposing longitudinal ends, the second fixing assembly being configured to enable the light bar to be affixed to an object when the light bar is removed from the case.

20 Claims, 11 Drawing Sheets

ROTATING AND REMOVABLE LIGHT BAR AND CASE FOR TRANSPORT/STORAGE OF THE SAME

CROSS REFERENCE TO RELATED APPLICATION

This application claims priority to U.S. application No. 62/782,452 filed Dec. 20, 2018, the entire contents of which are hereby incorporated by reference in its entirety.

TECHNICAL FIELD

Example embodiments generally relate to hand tools/accessories and, in particular, relate to a removable and rotatable light bar and a case that is configured to store or carry the same.

BACKGROUND

Drivable components such as drill bits, drivers and/or the like, have long been sold in sets that include different shapes and sizes. These sets would typically be sold in, or otherwise be capable of storage in cases that were made large enough to handle the entire set. Before the advent of standard-sized hex shanks, the diameter of straight drill bit shanks might vary with the diameter of the bit itself. Thus, the case would have a plurality of slots, each sized to hold a corresponding diameter of drill bit when the bit was secured in its respective slot. Case structures and layouts were therefore strictly dictated by the manufacturer of the cases. Although case structures were defined for numerous combinations and numbers of bits and/or drivers, the structures tended (regardless of how complex) to be relatively inflexible in relation to any ability to rearrange the locations of bits and/or drivers within the case.

However, with hex shanks becoming common, not only can many different sizes (and types) of drill bits all have a common shank size and shape, but many different sizes and types of drivers can also share the common shank size and shape. In particular, a quarter inch hex shank is fairly standard for use with bits and drivers of all types, shapes and sizes. Thus, the same receptacle can be used to hold each and every bit and driver within a case. This may enable the user to mix and match locations of the individual bits and drivers to any desirable set of selected locations within a case that is configured to include a plurality of hex shaped receptacles.

BRIEF SUMMARY OF SOME EXAMPLES

In an example embodiment, a light bar may be provided. The light bar may include a body, a battery housed inside the body, a lighting element housed inside the body, a switch operably coupled to the lighting element and the battery to enable control of lighting intensity of the lighting element based on a position of the switch, a first fixing assembly formed at opposing longitudinal ends of the body, and a second fixing assembly. The first fixing assembly may be configured to enable the light bar to be removable and rotatable relative to a case. The second fixing assembly may be disposed at a portion of the body that is between the opposing longitudinal ends, the second fixing assembly being configured to enable the light bar to be affixed to an object when the light bar is removed from the case.

In another example embodiment, a case for storing drivable components may be provided. The case may include a first half shell and a second half shell operably coupled to each other via a hinge, a frame member configured to be retained in at least one of the first half shell or the second half shell, and a light bar comprising a battery operated lighting element. The frame member may include holding slots disposed in lateral sides of the frame member. The light bar may be configured to be removable from the holding slots and rotatable in the holding slots between selected ones of a plurality of predetermined light bar orientations.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
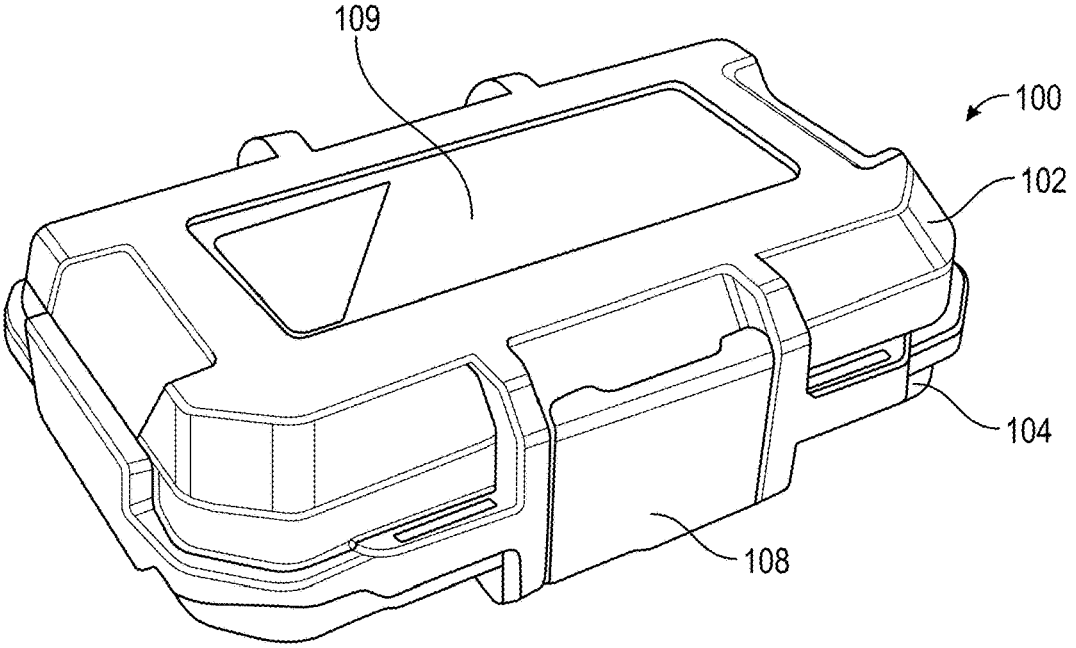
FIG. 1 illustrates a perspective view of a drivable component case according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a fully reconfigurable drivable component case that is capable of interfacing with a rotatable and removable light bar. The frame inside the case may be configured for receiving one or more rails that have a series of drivable component receptacles provided therein along with at least one instance of the light bar. The rails and the light bar may each be removable from the frame, but also be rotatable to various fixable positions when operably coupled to the frame. The case, the frame, the light bar and the rails in accordance with an example embodiment will now be described in reference to FIGS. 1-11, which illustrate various physical structures associated with a working example.

Figure 2:
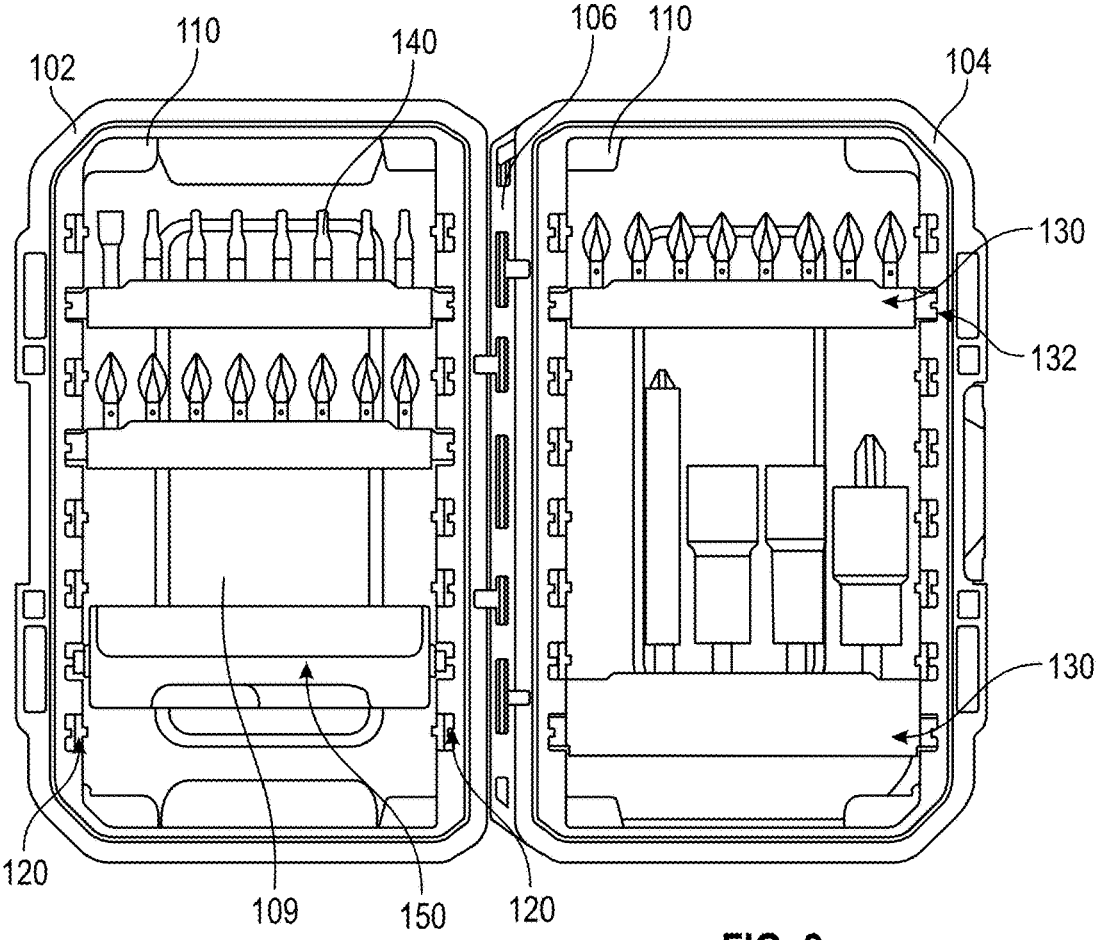
FIG. 2 illustrates top view of the case of FIG. 1 in an opened state according to an example embodiment.

FIG. 1 illustrates a perspective view of a drivable component case 100 according to an example embodiment, and FIG. 2 illustrates the case opened up so that inner portions thereof are visible. As can be appreciated from FIGS. 1 and 2, the case 100 may include a first half shell 102 and a second half shell 104 that may be hingedly attached to each other. The first and second half shells 102 and 104 may each include a base portion 109 (i.e., forming a top wall and a rear wall, respectively) and four sidewalls that each extend perpendicularly away from the base portion 109 (and substantially perpendicular to adjacent ones of the sidewalls) to define a container portion in each respective one of the first and second half shells 102 and 104. When the first and second half shells 102 and 104 rotate about hinge 106 toward each other, respective ones of the sidewalls of the first half shell 102 meet and align with the sidewalls of the second half shell 104 at distal edges thereof. Meanwhile, the base portions 109 of each of the first and second half shells 102 and 104 will lie in parallel planes that are spaced apart from each other by the height of the case 100. A locking mechanism 108 may be provided at sidewalls opposite the hinge 106 to enable the case to be locked in the closed position.

The container portion of each of the first and second half shells 102 and 104 may be configured to receive a frame member 110 (or simply "frame"). The frame members 110 of each of the first and second half shells 102 and 104 may be configured to snap fit or otherwise be affixed inside the container portion of their respective one of the first and second half shells 102 and 104. In an example embodiment, the frame members 110 may be configured to engage the sidewalls of the first and second half shells 102 and 104, and may extend from the base portion 109 along the sidewalls to be flush with distal ends of the sidewalls. More specifically, an outer periphery of the frame members 110 may lie adjacent to an inner periphery defined by the sidewalls of the first and second half shells 102 and 104. Meanwhile, an inner periphery of each of the frame members 110 may be formed to include a plurality of holding slots 120. In this regard, an equal number of holding slots 120 may be positioned on each opposing lateral side of the frame members 110 to correspond to each other. In other words, the holding slots 120 may be disposed in pairs on opposing lateral sides of each of the frame members 110. In the example of FIG. 2, the pairs of holding slots 120 may each be equidistant from each adjacent pair of holding slots 120. However, it should be appreciated that spacing between adjacent pairs of holding slots 120 need not be spaced equidistantly, and instead, any desired spacing therebetween could be employed. Moreover, although the pairs of holding slots 120 mirror each other in each of the instances of the frame members 110, such mirroring also does not necessarily need to be employed in alternative embodiments.

As shown in FIG. 2, a plurality of rails 130 may be stored within the case 100. More particularly, one instance of the rails 130 may be inserted into a corresponding pair of holding slots 120. The rails 130 may include retention bosses 132 at opposing longitudinal ends of the rails 130. The retention bosses 132 may be configured to interface with the holding slots 120 to allow each of the rails 130 to be both removable and rotatable relative to the holding slots 120. As will be discussed below, the rails 130 may be positioned to multiple different positions (e.g., one position during insertion and two positions after insertion) in which the rails 130 may be fixed relative to their respective frame member 110. However, at least one of the multiple different positions may be a storage position, which is shown in FIG. 2. In the storage position, bits or drivers (e.g., drivable components 140) that are inserted into the rails 130 and retained therein may lie such that a longitudinal centerline or axis thereof is substantially parallel to the plane of the base portion 109 of the case 100.

In an example embodiment, the drivable components 140 may include bits, sockets, drive heads, etc., of various shapes, sizes and/or types. In this example, each of the drivable components 140 may include a hex shaft (e.g., a quarter-inch hex shaft). Thus, spacing between the rails 130 may be selected such that when the rails 130 are retained in the storage position, a distance between adjacent rails 130 is at least longer than a length of any one of the drivable components 140 retained in one of the adjacent rails 130.

In an example embodiment, other accessories (e.g., light bar 150) may also be retained by the frame members 110. In this regard, for example, the light bar 150 may also include instances of the retention bosses 132 extending from opposing lateral ends thereof in order to interface with a selected pair of the holding slots 120 to allow retention, removal and rotation of the light bar 150 in similar fashion to the performance of the same functions relative to the rails 130.

Figure 3A:
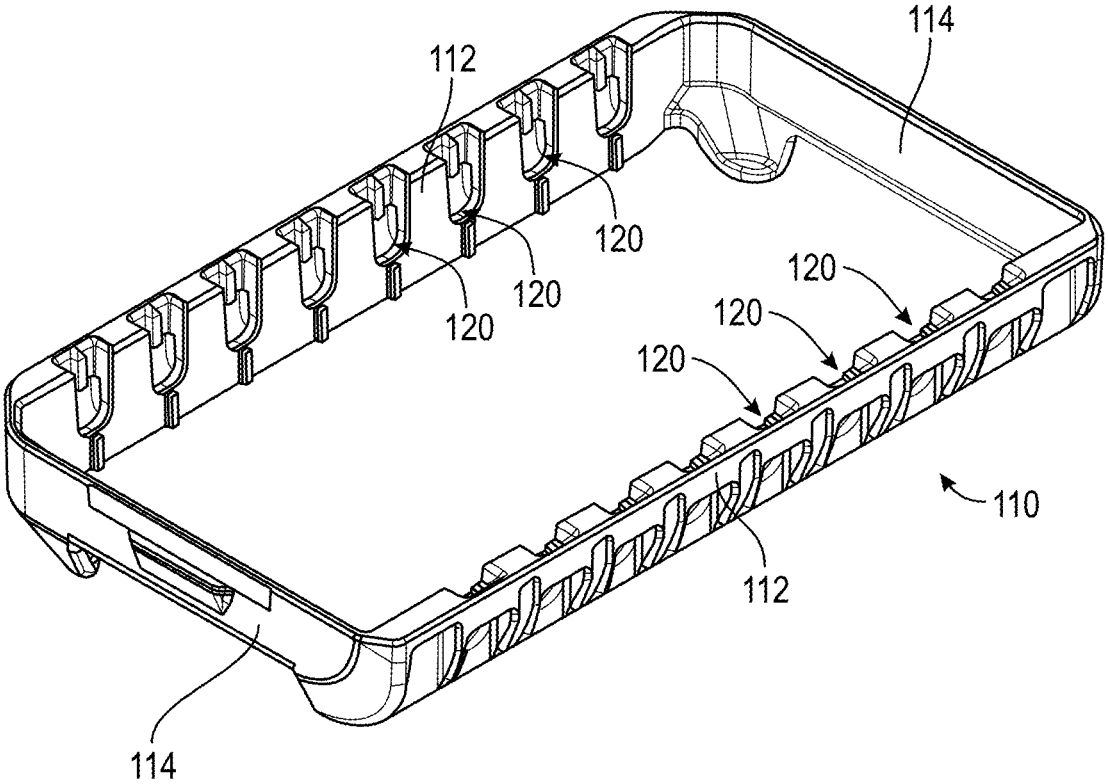
FIG. 3A illustrates a top perspective view of a frame of the case according to an example embodiment.
Figure 3B:
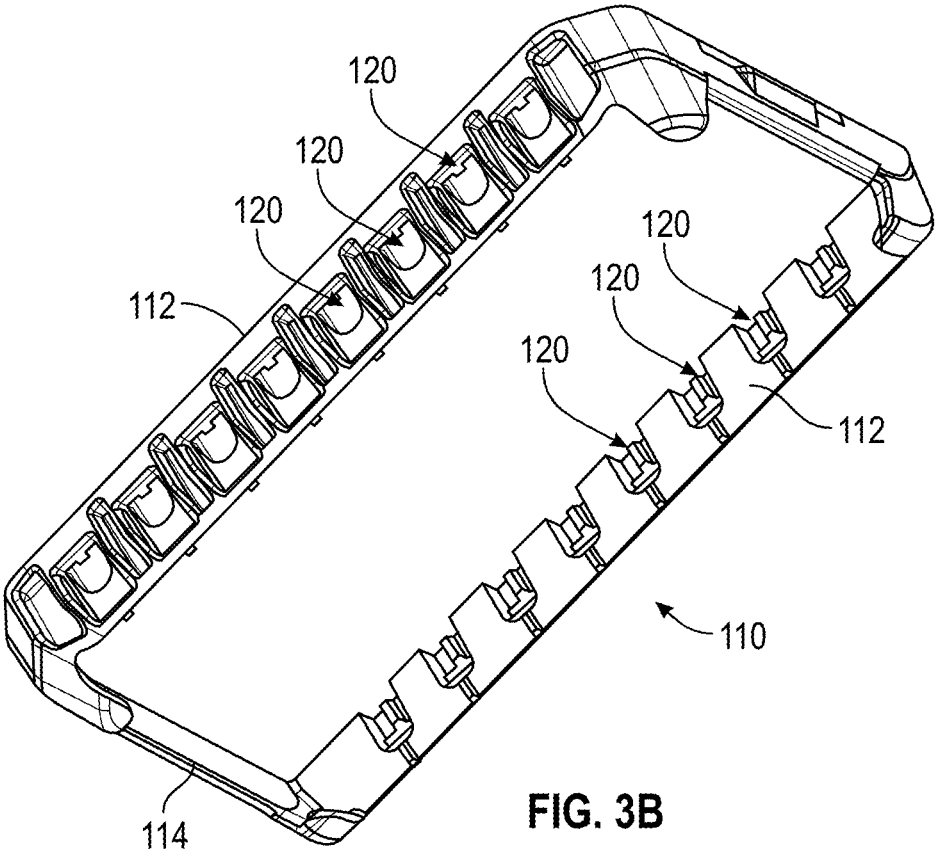
FIG. 3B illustrates a bottom perspective view of the frame of the case according to an example embodiment.
Figure 4A:
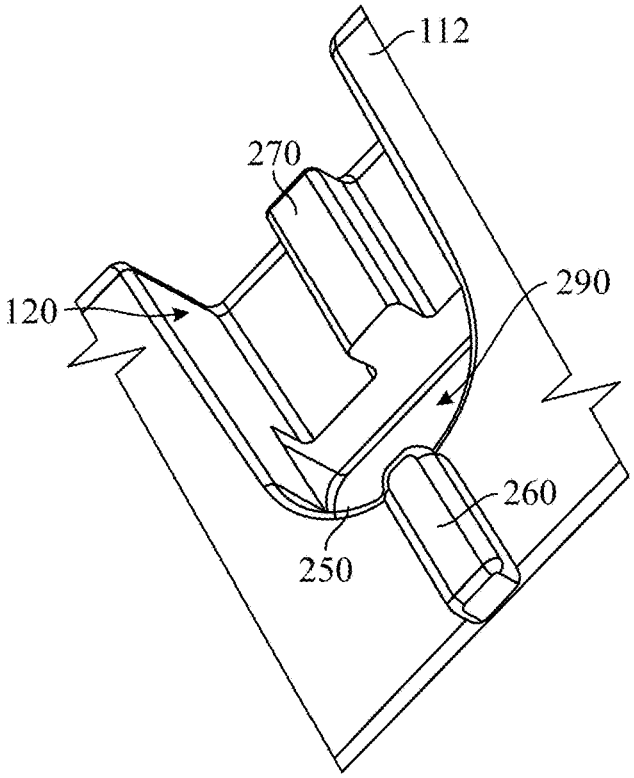
FIG. 4A illustrates a perspective view of a holding slot from inside the frame (looking out) according to an example embodiment.
Figure 4B:
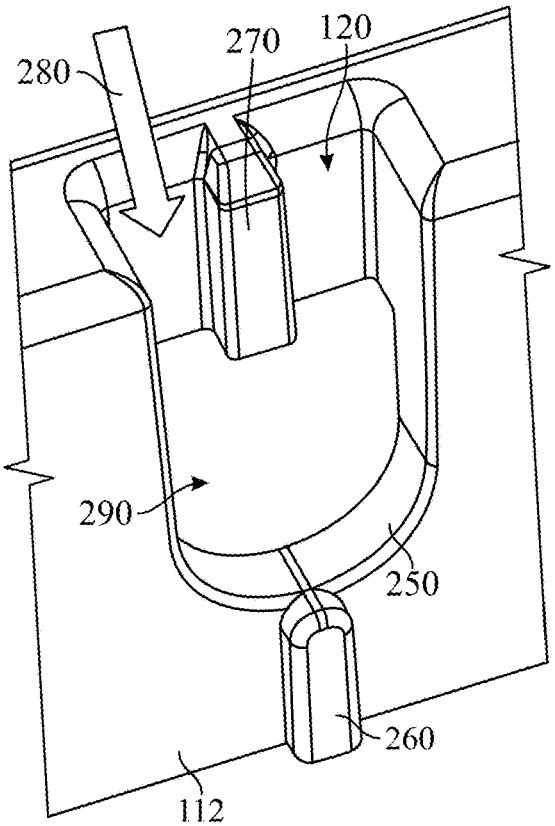
FIG. 4B illustrates an alternative perspective view of the holding slot from inside the frame according to an example embodiment.
Figure 4C:
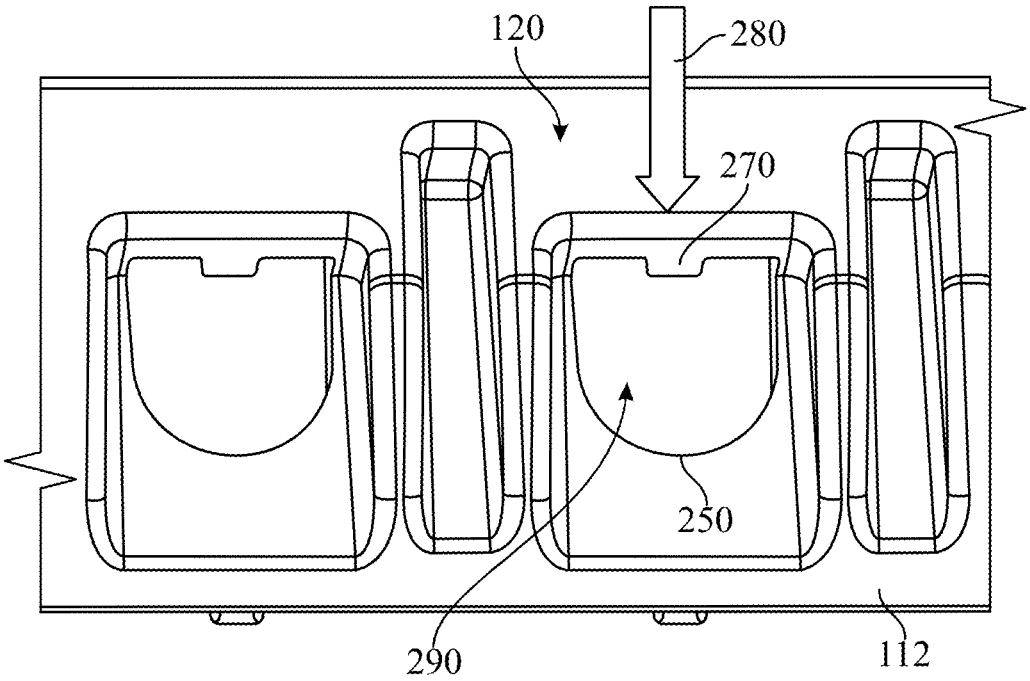
FIG. 4C illustrates a perspective view of a holding slot from outside of the frame (looking in) according to an example embodiment.
Figure 5A:
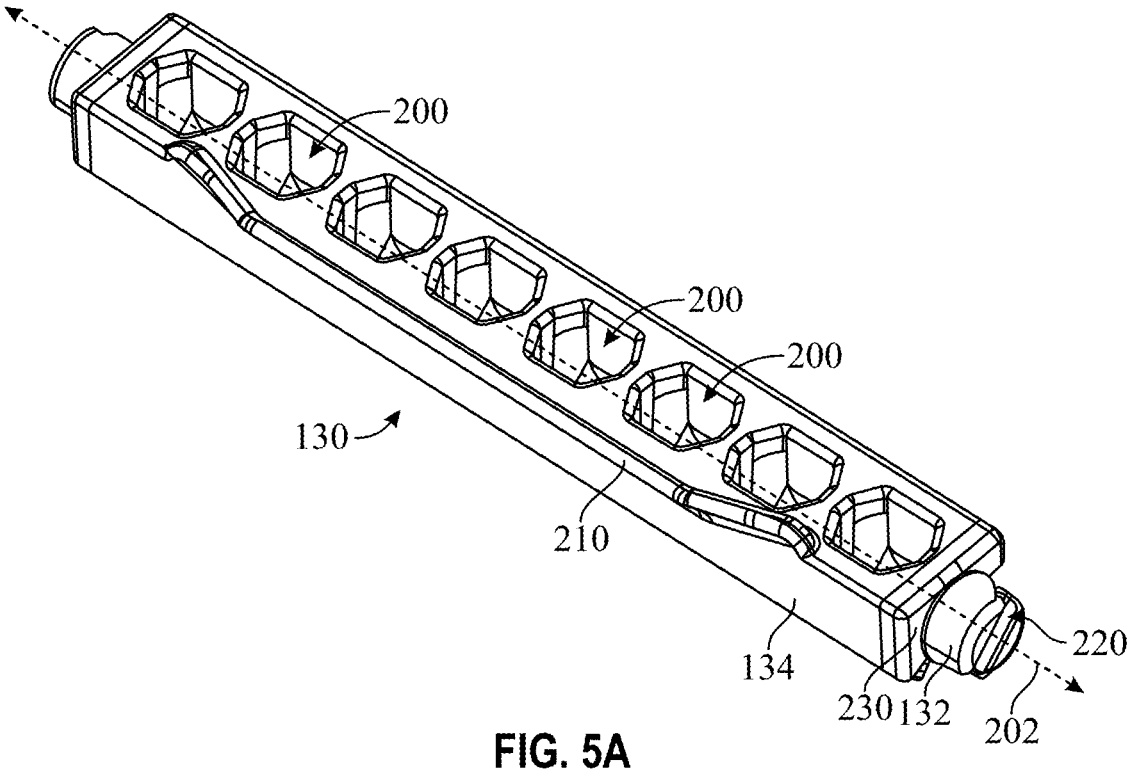
FIG. 5A is a top perspective view of a rotatable and removable rail that interfaces with the holding slot of the frame according to an example embodiment.
Figure 5B:
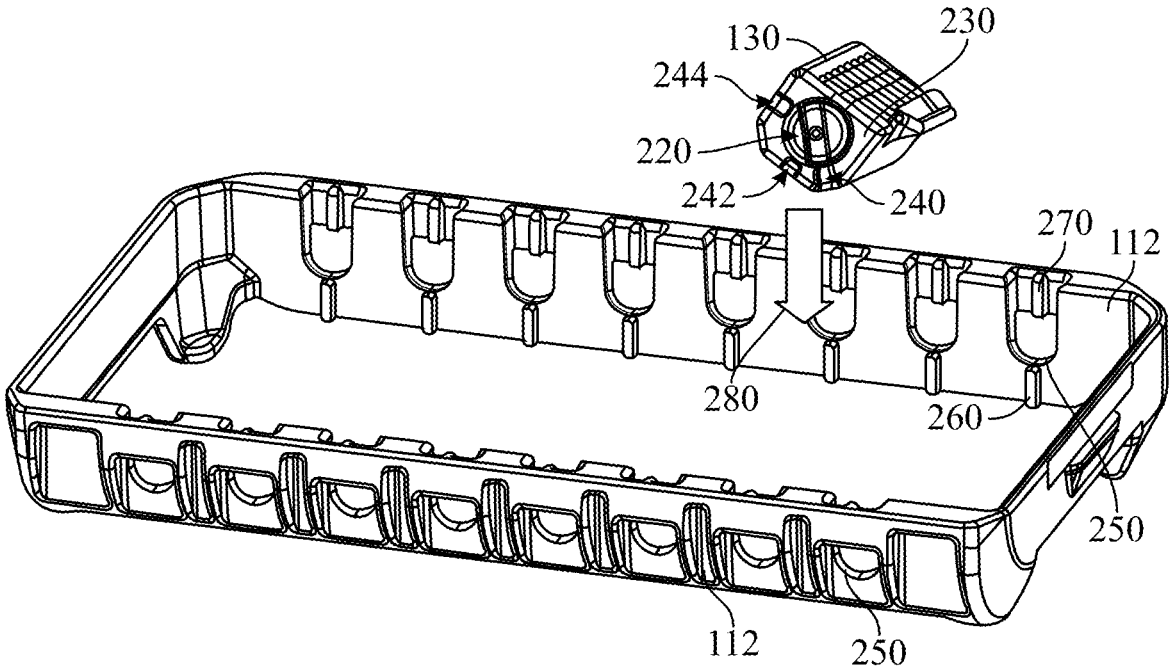
FIG. 5B illustrates a perspective view of the rail being inserted into the frame in accordance with an example embodiment.
Figure 5C:
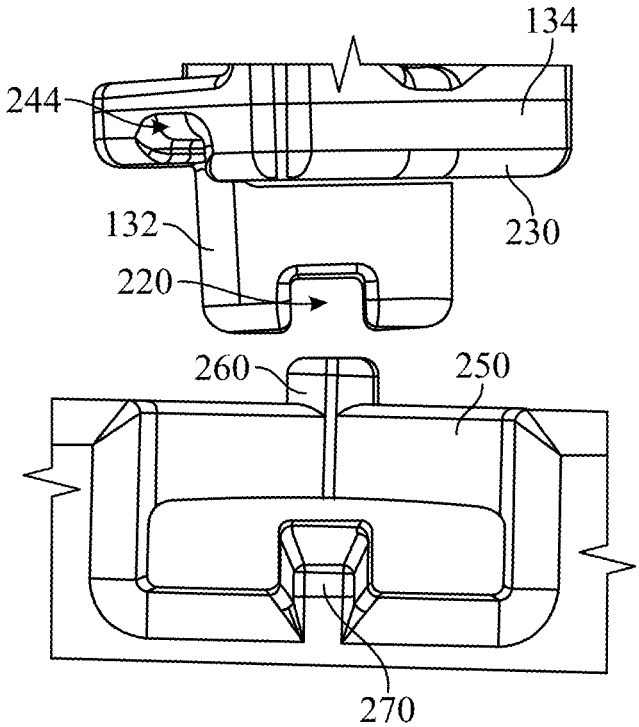
FIG. 5C illustrates a top view of the alignment of various components for insertion of a boss with the holding slot in accordance with an example embodiment.
Figure 6A:
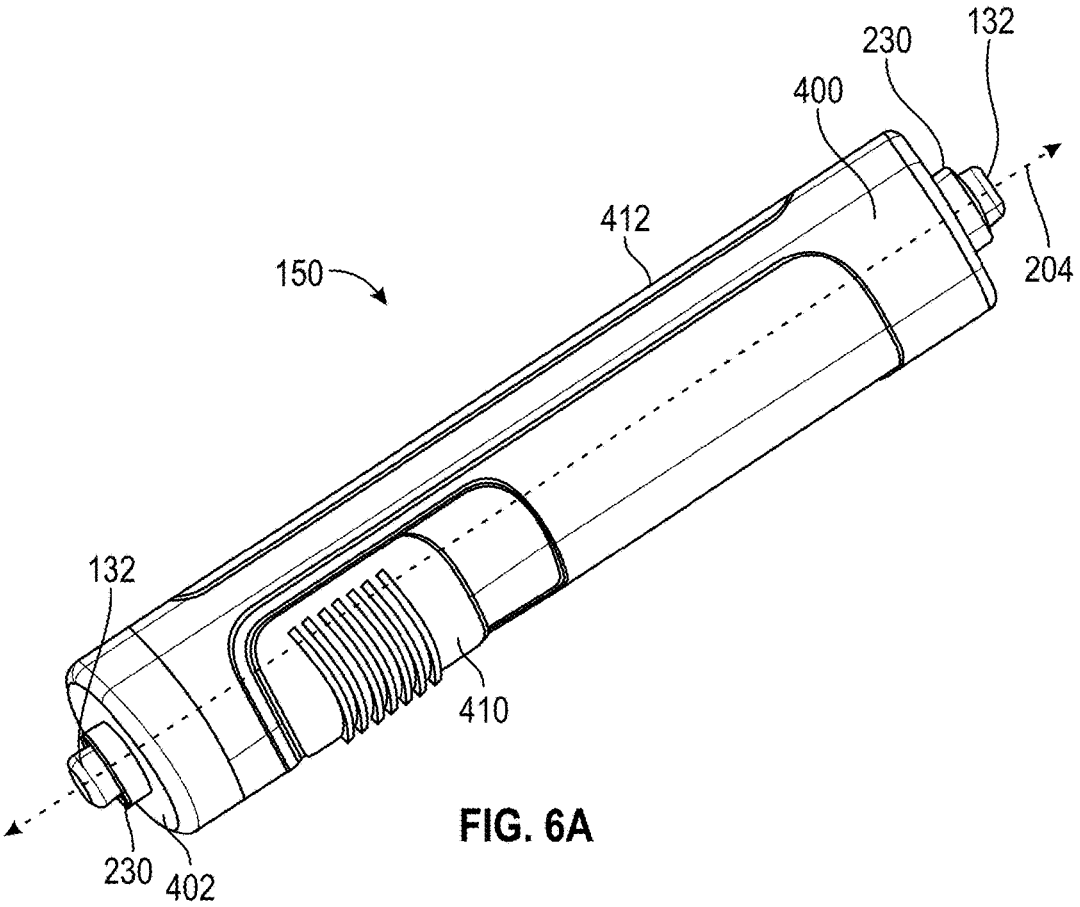
FIG. 6A illustrates a perspective view of a rotatable and removable light bar according to an example embodiment.
Figure 6B:
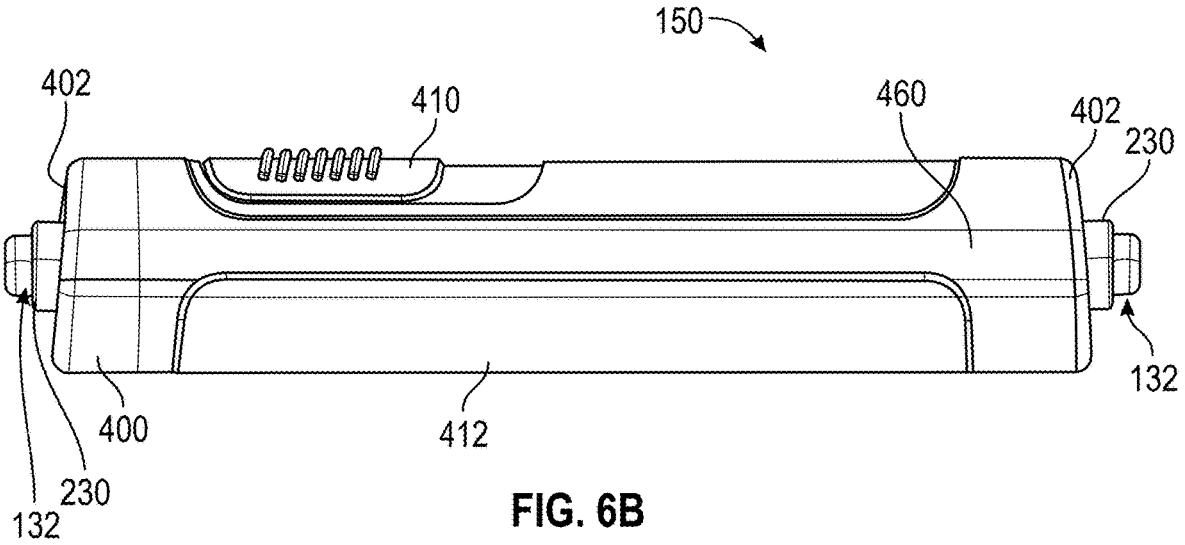
FIG. 6B illustrates a longitudinal side view of the rotatable and removable light bar of FIG. 6A according to an example embodiment.
Figure 6C:
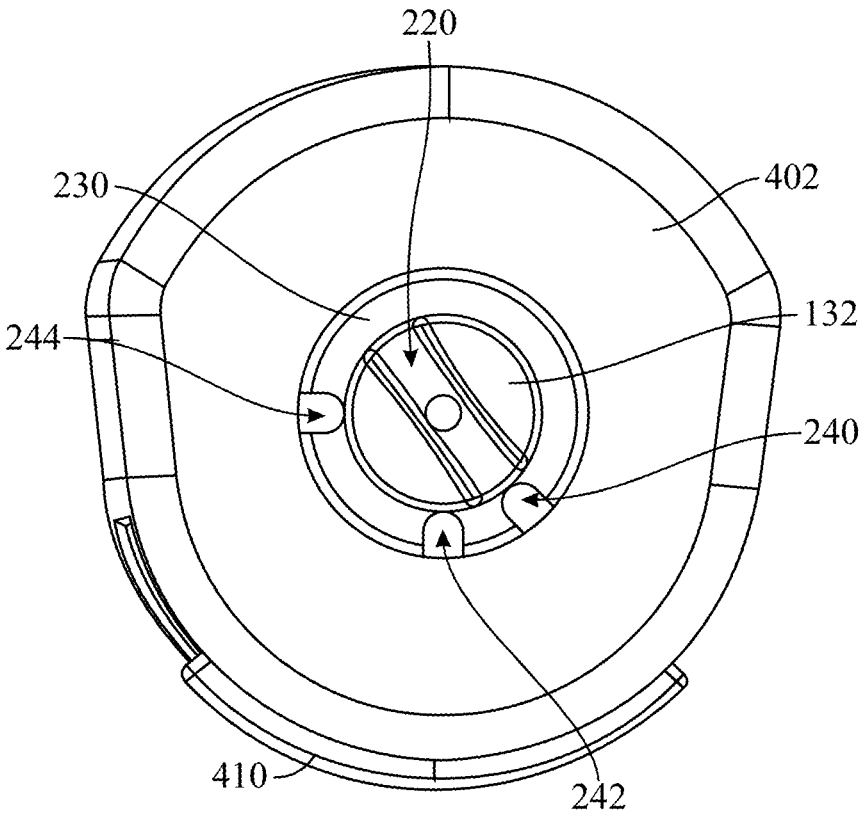
FIG. 6C illustrates a longitudinal end view of the rotatable and removable light bar of FIG. 6A according to an example embodiment.
Figure 7:
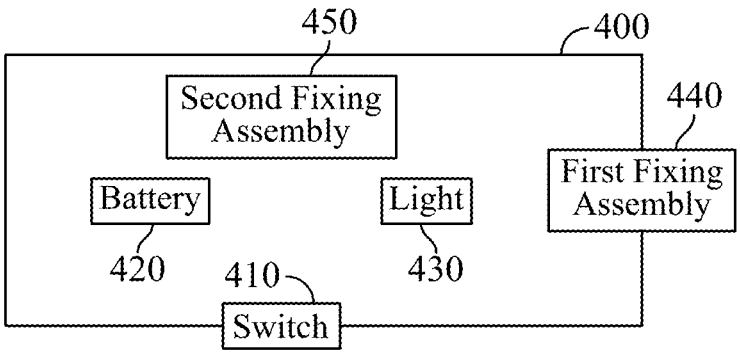
FIG. 7 illustrates a block diagram of the rotatable and removable light bar according to an example embodiment.
Figure 8:
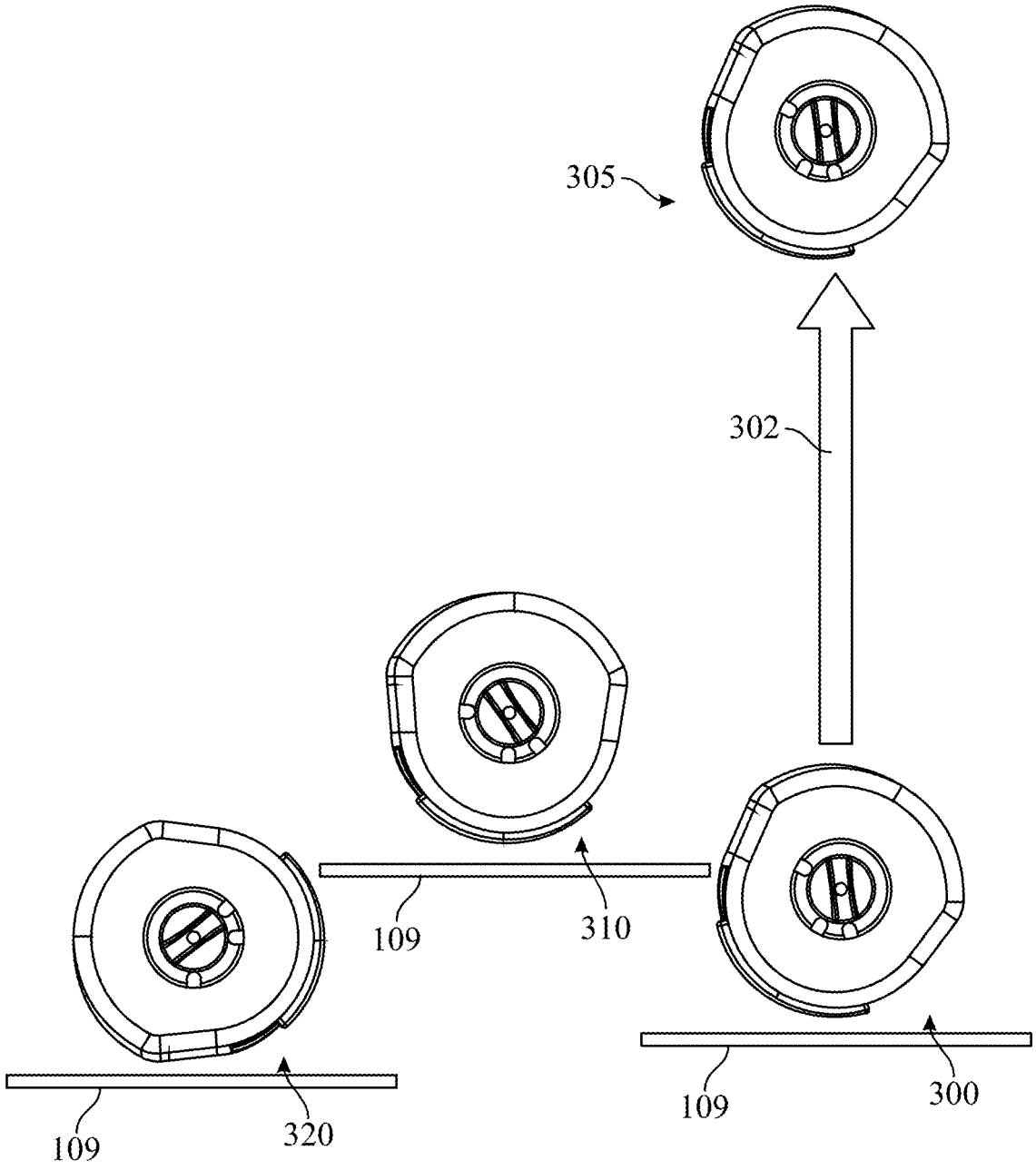
FIG. 8 is a side view showing three installed positions of the rotatable and removable light bar according to an example embodiment.

FIGS. 3A and 3B illustrate top and bottom perspective views of one instance of the frame member 110 of the case 100 of FIGS. 1 and 2. FIGS. 4A, 4B and 4C illustrate various views of one instance of the holding slot 120 to facilitate a discussion of the same. FIGS. 5A, 5B, and 5C illustrate various views of one instance of the rail 130 described above in reference to FIGS. 1 and 2 to illustrate how the rail 130 can be inserted into the frame member 110 via the holding slots 120. FIGS. 6A, 6B and 6C illustrate various views of the light bar 150 and its retention bosses 132, while FIG. 7 shows a block diagram so that various internal components of the light bar 150 can also be described. FIG. 8 shows three fixable positions for the light bar based on alignment (or non-alignment) of the retention bosses 132 with alignment features of the holding slots 120. FIGS. 9A, 9B, 9C and 9D may then be used to describe these alignment or non-alignment conditions in greater detail.

Referring primarily to FIG. 3, which is defined by FIGS. 3A and 3B, the frame member 110 may include lateral sides 112 and transverse sides 114 that are arranged to form a substantially rectangular shape. In this regard, the transverse sides 114 extend parallel to each other between respective ends of the lateral sides 112. The holding slots 120 are formed in the lateral sides 114 in pairs that mirror each other in position and structure. In particular, the holding slots 120 are formed at least in part by an absence (or removal) of material from the lateral sides 112 to form structures that interface with the rails 130 and/or light bar 150 (and particularly with the retention bosses 132) to enable the rails 130 and/or light bar 150 to be removable from and rotatable within the holding slots 120 as described in greater detail below.

As shown in FIG. 5, which is defined by FIGS. 5A-5C, each instance of the rail 130 may include a plurality of receptacles 200 formed in a body 134 of the rail 130. The receptacles 200 may be substantially hex shaped, and may be configured to retain a quarter-inch hex shaft responsive to insertion of the quarter-inch hex shaft therein. The receptacles 200 may be disposed in a sequential array that is substantially in alignment with a longitudinal centerline or axis 202 of the rail 130 at a top portion of the rail 130. Although eight receptacles 200 are shown in this example, any suitable number may be included in various example embodiments based on the size of the case 100. Each of the receptacles 200 may extend substantially perpendicular to the axis 202 of the rail 130 so that, for example, an axis of each respective one of the driving components 140 that is inserted into the receptacles 200 is perpendicular to the axis 202 of the rail 130 as well. A lip portion 210 may be defined at a top portion of the rail 130 to enable an operator to grasp the lip portion 210 with a finger and rotate the rail 130. The rail 130 may rotate about the axis 202 when inserted into the holding slots 120 and not affixed therein. As mentioned above, the retention bosses 132 may be disposed at opposing longitudinal ends of the rail 130. The axis 202 of the rail 130 may be aligned with an axis of the retention bosses 132.

Each of the retention bosses 132 may include an alignment slot 220 that extends through and forms a groove in a distal end of the retention boss 132. In this regard, the alignment slot 220 may extend substantially perpendicular to the axis 202. The retention boss 132 of each longitudinal end of the rail 130 may extend outwardly away from a base surface 230 of the rail 130. The base surface 230 of this example happens to also be an end face of the body 134 of the rail 130. However, the base surface 230 could alternatively be raised separately from the body 134 in some cases. The base surface 230 may lie in a plane that is substantially perpendicular to the axis 202. The alignment slot 220 may therefore extend in a direction that is parallel to the plane of the base surface 230. However, the alignment slot 220 may be spaced apart from the base surface 230 due to the extension of the retention boss 132 away from the body 134 of the rail 130.

In an example embodiment, a plurality of locking slots (see FIG. 5B) may be formed in the base surface 230. Each of the locking slots may have a predetermined orientation relative to the alignment slot 220 and each other. In this regard, a first locking slot 240 may extend radially inwardly from a peripheral edge of the base surface 230 toward the axis 202. The first locking slot 240 may be substantially aligned with the alignment slot 220. A second locking slot 242 may be offset from the first locking slot 240 by about 45 degrees. The second locking slot 242 may therefore be substantially aligned with an axis of the driving components 140 when inserted into the receptacles 200 (and therefore the direction of insertion of driving components 140 into the receptacles 200). Thus, as can be appreciated from the description above, the alignment slot 220 may extend across the distal end of the retention boss 132 in a direction that is offset from the direction of insertion of driving components 140 into the receptacles 200 by about 45 degrees. The second locking slot 242 may also extend radially inwardly from a peripheral edge of the base surface 230 toward the axis 202.

Meanwhile, a third locking slot 244 may be disposed in the base surface 230 to extend radially inwardly from a peripheral edge of the base surface 230 toward the axis 202. The second locking slot 242 may be offset from the first locking slot 240 by about 135 degrees and offset from the second locking slot 242 by about 90 degrees. The third locking slot 244 may therefore be substantially perpendicular to the axis of the driving components 140 when inserted into the receptacles 200 (and therefore the direction of insertion of driving components 140 into the receptacles 200).

Each opposing base surface 230 may include a corresponding set of the first, second, and third locking slots 240, 242 and 244 that mirror each other. Similarly, each opposing end of the rail 130 may include a retention boss 132 having its own respective instance of the alignment slot 220 formed therein. The retention bosses 132 and alignment slots 220 formed therein may also mirror each other.

As shown in FIG. 6, which is defined by FIGS. 6A, 6B and 6C, the light bar 150 also extends longitudinally along an axis 204. The retention bosses 132 are coaxial with the axis 204, and extend from respective instances of the base surface 230 which are formed at opposite ends of a body 400 of the light bar 150. The body 400 of this example has slanted end faces 402, and the base surface 230 is raised away from the end faces 402. The first, second and third locking slots 240, 242 and 244 are formed in the base surface 230 in the same manner described above in reference to the rails 130. However, it should be appreciated that, in some cases, the end faces 402 could directly incorporate the first, second and third locking slots 240, 242 and 244 therein (e.g., instead of separately forming the base surface 230).

The light bar 150 may further include a multi-position switch 410. The switch 410 may include positions such as on and off. However, in some cases, instead of simply having an on position, the switch 410 may include various power or light intensity settings such as, for example, low and high. The switch 410 may be configured to slide along the body 400 between the different positions, and may be electrically connected to internal components (see FIG. 7) that enable operation of the light bar 150. The internal components may include a battery 420 (e.g., a rechargeable or disposable battery) and a light element 430 (e.g., a light emitting diode (LED), incandescent or other such illumination device). The operation of the switch 410 may control the application of power from the battery 420 to the light element 430 to either turn the light element 430 on/off, or control the intensity of the light emitted by the light element 430.

As also shown in FIG. 7, the light bar 150 may include two distinctly different fixing assemblies that allow the light bar 150 to be affixed to various devices or components. For example, a first fixing assembly 440 may be provided to enable the light bar 150 to be rotatably and removably attached to the case 100. As such, the first fixing assembly 440 may be understood to include the retention bosses 132, the alignment slots 220, and the first, second and third locking slots 240, 242 and 244. The second fixing assembly 450 may be configured to enable the light bar 150 to be affixed to devices or components other than the case 100. For example, the second fixing assembly 450 may be embodied as one or more magnets that are disposed in or near one or more surfaces of the body 400. In some cases, as shown in FIG. 6B, a magnetic strip 460 may be formed conformal with the body 460 on one or both sides of the light bar 150. However, it should be appreciated that magnets could alternatively be placed behind portions of the body 460 and act through the body 400 on metallic objects.

In some cases, the switch 410 may be disposed on an opposite side of the body 400 relative to a light window 412. Moreover, the switch 410 may be formed within a recessed portion of the body 400 to reduce the amount of the switch 410 that is not conformal with the body 400. The light window 412 of some examples may be conformal with the body 400. The light window may also be translucent so that the light element 430 may emit light through the light window 412 when the switch 410 is set to on, or to one of the light intensity settings.

Referring now primarily to FIG. 4, which is defined by FIGS. 4A-4C, the structural features of the holding slots 120 will be described in greater detail. In this regard, the frame member 110 may have a width that is about equal to the length of the rails 130 and the length of the light bar 150. The holding slots 120 may be formed in the lateral sides 112 of the frame member 110 to allow the rail 130 or light bar 150 (particularly the retention bosses 132 thereof) to be inserted therein such that a portion of the holding slot 120 is closer to the same portion of its respective pair holding slot 120 in the frame 110 than the length of the rail 130 or light bar 150, while another portion of the holding slot 120 is farther from the same portion of its respective pair holding slot 120 on the other side of the frame 110 so that the retention bosses 132 fit therebetween. In particular, the holding slot 120 may include a collar portion 250 that is spaced apart from the collar portion 250 of the opposing holding slot 120 on the other side of the frame member 110 by a distance slightly larger than a length of the body 134 of the rail 130 or the body 400 of the light bar 150. The collar portion 250 may have a depth that is about equal to a length of the rails 130 and the light bar 150 from end to end of the retention bosses 132 so that all or nearly all of the retention boss 132 on each opposing end of the rail 130 or light bar 150 may rest on the collar portion 250 of its corresponding lateral side 112 when the rail 130 or light bar 150 is inserted into the holding slots 120. The collar portion 250 may form an arcuate shape having a radius slightly larger than a radius of the retention boss 132. Thus, the retention boss 132 may be supportable on the collar portion 250, but may also be rotatable relative to the collar portion 250 when the retention boss 132 is not locked in a particular position.

Locking of the retention boss 132 may be accomplished using a locking protrusion 260 disposed adjacent to the collar portion 250. In this regard, the locking protrusion 260 may protrude toward a center of the frame member 110 from an inner portion of the lateral side 112 next to each respective collar portion 250. A longitudinal length of the locking protrusion 260 may extend substantially perpendicular to a direction of longitudinal extension of the lateral side 112, and may terminate at or proximate to an apex of the collar portion 250. The locking protrusion 260 may have a width and depth that is substantially similar to a width and depth of the first, second and third locking slots 240, 242 and 244. As will be described in greater detail below, the lock protrusion 260 may be aligned with and inserted into a respective one of the first, second and third locking slots 240, 242 and 244 in order to lock the rail 130 or light bar 150 at a particular orientation within the case 100.

Each instance of the holding slot 120 may also include an alignment protrusion 270 that extends in a direction parallel to the direction of extension of the locking protrusion 260. The alignment protrusion 270 may have a width and depth (and perhaps also length) that is substantially similar to a width and depth (and length) of the alignment slot 220. The length of the rails 130 and the light bar 150 from end to end of the retention bosses 132 may be such that the rail 130 or light bar 150 cannot be inserted into the holding slot 120 unless the alignment protrusion 270 is aligned with the alignment slot 220. However, when the alignments slots 220 on each of the retention bosses 132 are aligned with each other, the rail 130 or light bar 150 may be slid downward (in the direction of arrow 280) until the retention bosses 132 clear the bottom of the alignment protrusion 270 entirely and the retention bosses 132 are disposed in a receiving orifice 290 formed between the collar portion 250 and the alignment protrusion 270. The receiving orifice 290 may be larger than a diameter of the retention boss 132 to allow the retention boss 132 to be rotatable therein, whether or not the locking protrusion 260 is engaged with one of the first, second and third locking slots 240, 242 and 244.

Accordingly, as shown in FIGS. 5B and 5C, the rail 130 (or the light bar 150) may be positioned above the frame member 110 so that the alignment slot 220 is substantially aligned with the alignment protrusion 270 for each holding slot 120 of a given pair. Simultaneously, the rail 130 (or light bar 150) may be lowered in the direction of arrow 280 so that the alignment protrusion 270 of each of the holding slots 120 passes through the alignment slot 220 of each respective retention boss 132. When the alignment protrusion 270 is no longer in contact with the alignment slot 220 and the retention bosses 132 are each located in the receiving orifice 290, the rail 130 can be rotated about the axis 202 within the receiving orifices 290 on respective ends of the rail 130. One of the first, second and third locking slots 240, 242 and 244 may then be aligned with and inserted into the locking protrusion 260 to prevent further rotation of the rail 130 and lock the rail 130 (or light bar 150) in place. In particular, the first locking slot 240 may be aligned already with the locking protrusion 260 when the alignment protrusion 270 and alignment slot 220 are already aligned. However, once the retention bosses 132 are located in the receiving orifices 290, the retention bosses 132 can be rotated to align and lock in either of the other two lockable positions.

Figure 9A:
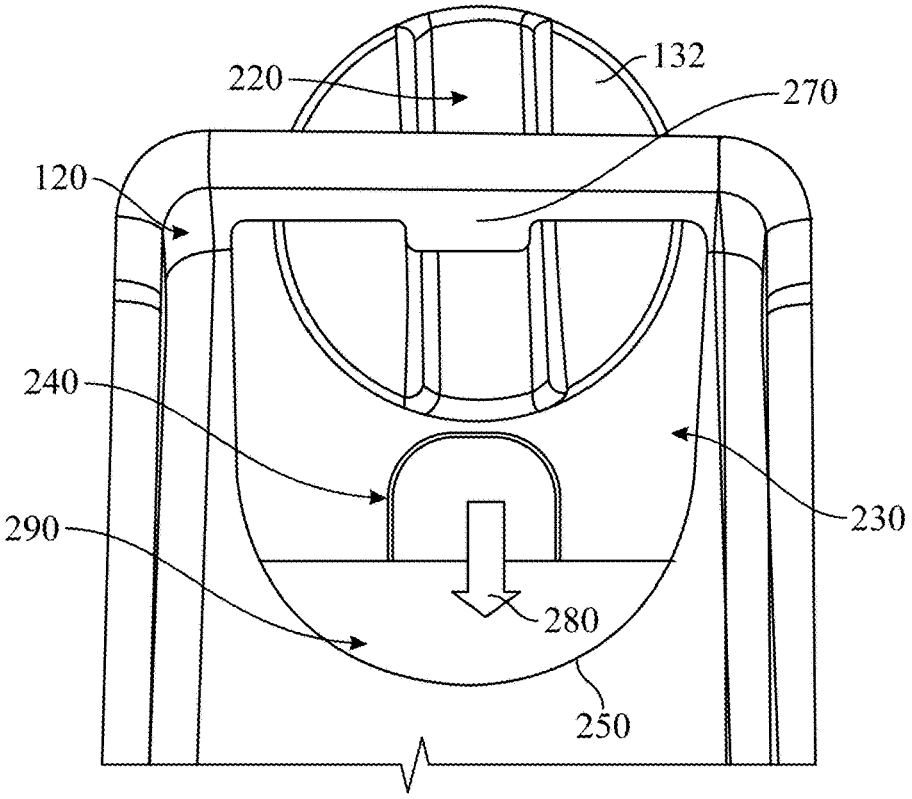
FIG. 9A is a side view of the boss being inserted into the holding slot according to an example embodiment.
Figure 9B:
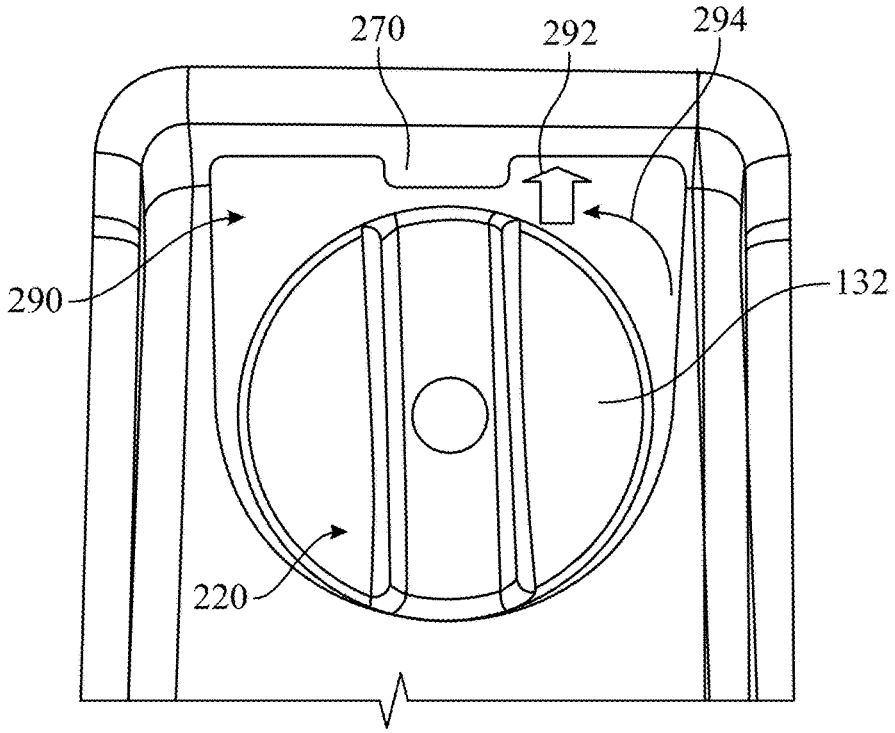
FIG. 9B is a side view of the boss within the holding slot in alignment for installation or removal according to an example embodiment.

FIG. 8 and FIG. 9, which is defined by FIGS. 9A, 9B, 9C and 9D, show side views of the light bar 150 and the retention boss 132 of one side of the light bar 150 in each of the three lockable positions. In this regard, FIG. 9A shows the retention boss 132 being inserted into the holding slot 120 (i.e., moved downward in the direction of arrow 280) until the light bar 150 is locked in place via engagement of the first locking slot 240 and the locking protrusion 260 as shown in FIG. 9B. The position shown in FIG. 9B correlates to the install/remove position 300 shown in FIG. 8. In the install/remove position 300, the driven component 140 extends substantially at a 45 degree angle relative to the base portion 109 of the case 100. The light bar 150 can then be removed as shown by arrow 302 to the removed position 305 shown in FIG. 8.

From the position shown in FIG. 9B, the retention boss 132 may be withdrawn in the direction of arrow 292 far enough to withdraw the locking protrusion 260 from the first locking slot 240. Then the retention boss 132 may be rotated in the direction of arrow 294 to achieve alignment between the locking protrusion 260 and the second locking slot 242. However, in some cases, the frame member 110 may be sized such that the retention boss 132 consumes all of the space between the collar portion 250 and the locking protrusion 270. In such examples, the frame member 110 may be resilient enough to flex to allow the locking protrusion 260 to flex outwardly and permit the locking protrusion 260 to exit the first locking slot 270 and slide over the base portion 230 rotating in the direction of arrow 294 to the second locking slot 242. The locking protrusion 260 may be seated within the second locking slot 242 and the position shown in FIG. 9C may be achieved. The position shown in FIG. 9C correlates to the use position 310 shown in FIG. 8. In the use position 310 of FIG. 8, the light window 412 is pointing substantially perpendicularly away from the base portion 109 of the case 100.

Figure 9C:
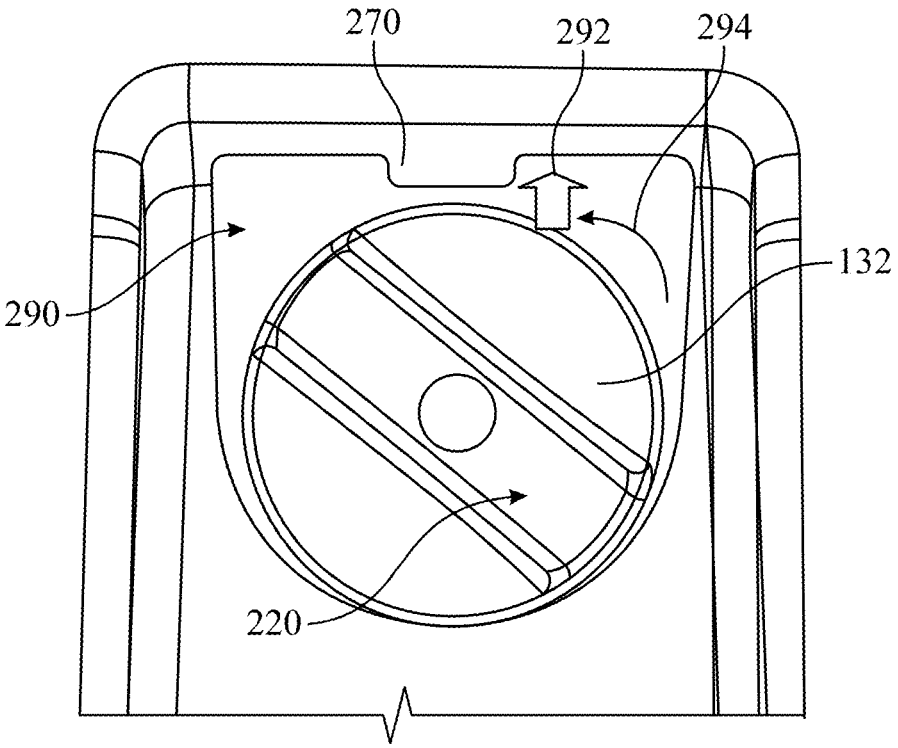
FIG. 9C is a side view of the boss being retained within the holding slot and locked in an in-use position according to an example embodiment.

As shown in FIG. 9C, the retention boss 132 may be withdrawn in the direction of arrow 292 far enough to withdraw the locking protrusion 260 from the second locking slot 242 (or slid out of the second locking slot 242 due to flexing of the frame member 110 as described above). Then the retention boss 132 may be rotated in the direction of arrow 294 to achieve alignment between the locking protrusion 260 and the third locking slot 244. The locking protrusion 260 may be seated within the third locking slot 244 and the position shown in FIG. 9D may be achieved. The position shown in FIG. 9D correlates to the storage position 320 shown in FIG. 8. In the storage position 320 of FIG. 8, the light window 412 may extend substantially parallel to the base portion 109 of the case 100.

Figure 9D:
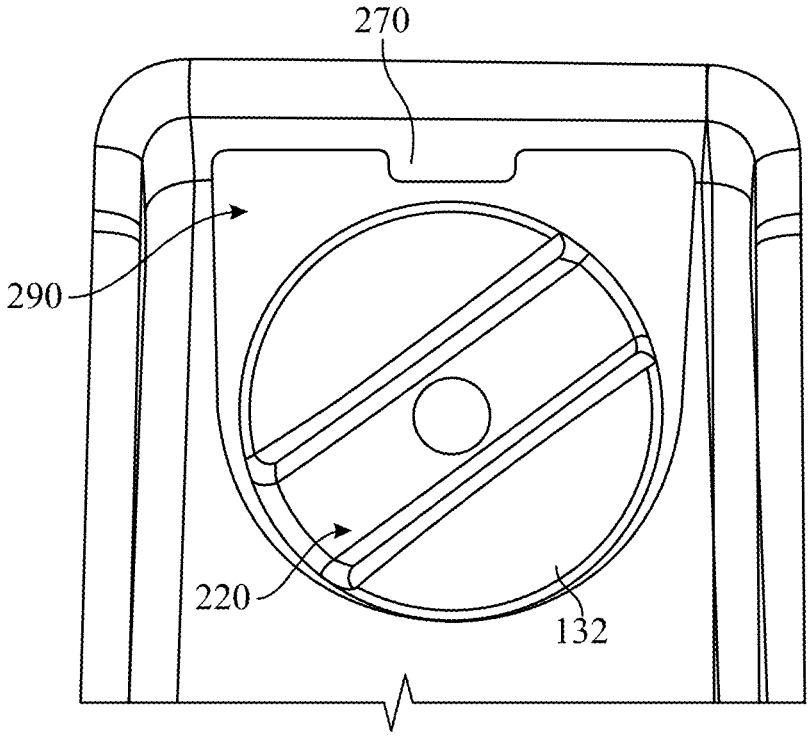
FIG. 9D is a side view of the boss being retained within the holding slot and locked in a storage position according to an example embodiment.

When the retention boss 132 is in the positions shown in FIGS. 9B, 9C and 9D, the retention boss 132 may be considered to be in a locked (or fixed) state. In this regard, rotation of the retention boss 132 within the receiving orifice 290 may not be possible (or at least be inhibited until enough force is exerted to cause the frame member 110 to flex to release the locking protrusion 260 from one of the locking slots) in the locked state. However, when the retention boss 132 is not locked relative to the collar portion 250, but still located in the receiving orifice 290, the retention boss 132 may be considered to be in a rotatable state. In this regard, the retention boss 132 (and therefore the light bar 150 or the rail 130) may be rotated relative to the frame member 110 and the holding slots 132. In some cases, the rotation may enable the retention boss 132 to be rotated to a different one of the potential fixed positions in which the retention boss 132 can be locked (e.g., associated with the first, second and third locking slots 240, 242 and 244). Moreover, at any time during which the alignment slot 220 and the alignment protrusion 270 are not in alignment, the alignment protrusion 270 may prevent withdrawal of the retention boss 132 from the holding slots 120.

Figure 10:
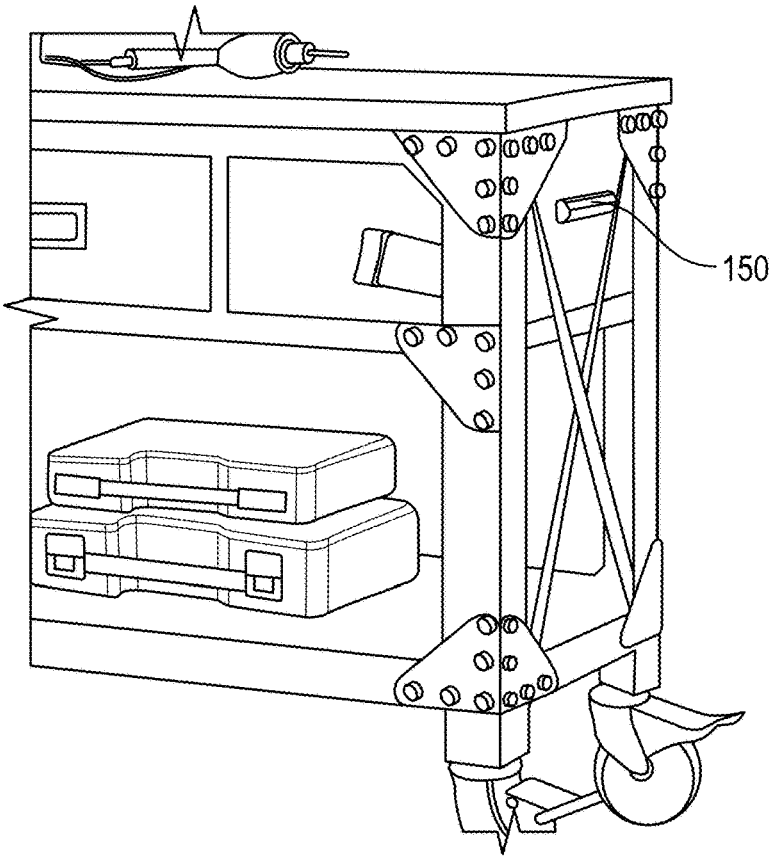
FIG. 10 illustrates a perspective view of the light bar attached to a work bench in accordance with an example embodiment.
Figure 11:
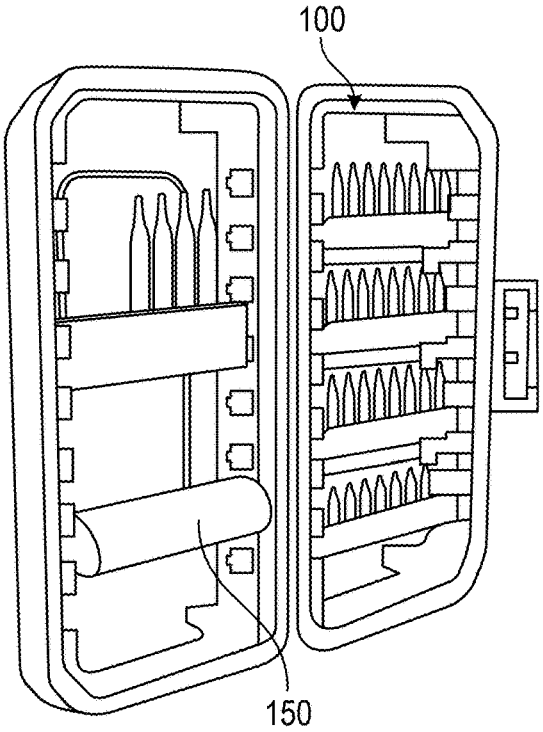
FIG. 11 illustrates a perspective view of the light bar in use within the case in accordance with an example embodiment.

The descriptions above indicate how the first fixing assembly 440 may operate to allow the light bar 150 to be rotatable and removable relative to case 100. Moreover, as shown in FIG. 11, the light element 430 may be illuminated while the light bar 150 is within the case 100, particularly when the light bar 150 is rotated to the use position 310 of FIG. 8. However, as noted above, the second fixing assembly 450 may also enable the light bar 150 to be affixed to other components. FIG. 10 illustrates the light bar 150 attached to the side of a metallic surface (in this case, a work bench). It should be appreciated that the metallic surface could be any other suitable metallic surface including other machinery, tools, or structural components.

Accordingly, some example embodiments may provide a light bar. The light bar may include a body, a replaceable or rechargeable battery housed inside the body, a lighting element housed inside the body, a switch operably coupled to the lighting element and the battery to enable control of lighting intensity of the lighting element based on a position of the switch, a first fixing assembly formed at opposing longitudinal ends of the body, and a second fixing assembly. The first fixing assembly may be configured to enable the light bar to be removable and rotatable relative to a case. The second fixing assembly may be disposed at a portion of the body that is between the opposing longitudinal ends, the second fixing assembly being configured to enable the light bar to be affixed to an object when the light bar is removed from the case.

The case and/or the light bar described above may be augmented or modified by altering individual features mentioned above or adding optional features. The augmentations or modifications may be performed in any combination and in any order. For example, in some cases, the light element may include a light emitting diode or an incandescent light bulb. In an example embodiment, the light bar may further include a multi-position switch disposed at a portion of the body. The multi-position switch may define at least an off position and two on positions corresponding to different light intensity settings. In some cases, the second fixing assembly may include a magnet disposed in the body to enable the body to be affixed to a metallic object. In an example embodiment, the magnet may be formed conformal with the body. In some cases, the case may include holding slots, and the first fixing assembly may be configured to be removable from the holding slots and rotatable in the holding slots between selected ones of a plurality of predetermined light bar orientations. In an example embodiment, the first fixing assembly may include a retention boss formed at each of the opposing longitudinal ends of the body. The retention boss may extend away from a base surface of the body. The retention boss may further include an alignment slot formed therein. The light bar may be removable from or insertable into the holding slots based on alignment of the alignment slot and an alignment protrusion of one of the holding slots. The light bar may be rotatable when retained in the holding slots. In an example embodiment, the base surface may include a plurality of locking slots extending radially outwardly from the retention boss. In some cases, the case further includes a locking protrusion. The locking protrusion may be alignable with a selected one of the locking slots to insert the locking protrusion into the selected one of the locking slots to fix the light bar relative to the frame member. In an example embodiment, the holding slots may each further include a collar portion disposed proximate to a locking protrusion and defining a receiving orifice. The locking protrusion and alignment protrusion may be disposed on opposite sides of the receiving orifice. The retention boss may be rotatable within the receiving orifice when neither the alignment slot nor any one of the locking slots engages a respective one of the alignment protrusion and the locking protrusion. In an example embodiment, a first locking slot may be substantially aligned with the alignment slot, and the locking protrusion is aligned with the alignment protrusion such that the light bar is positionable to align both the first locking slot with the locking protrusion and the alignment slot with the alignment protrusion to enable installation and fixing of the light bar relative to the frame member. In some cases, a second locking slot may be disposed about 45 degrees away from the first locking slot in the base surface. The second locking slot may be engageable with the locking protrusion to define a use position in which the light bar is fixed in an orientation in which a light window of the light bar faces substantially perpendicularly away from a base portion forming an outer wall of the case. In an example embodiment, a third locking slot may be disposed about 135 degrees away from the first locking slot in the base surface. The third locking slot may be engageable with the locking protrusion to define a storage position in which the light bar is fixed in an orientation in which a light window of the light bar faces substantially parallel to a base portion forming an outer wall of the case.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A light bar comprising:

a body;

a battery housed inside the body;

a lighting element housed inside the body;

a switch operably coupled to the lighting element and the battery to enable control of lighting intensity of the lighting element based on a position of the switch;

a first fixing assembly formed at opposing longitudinal ends of the body, the first fixing assembly being configured to engage with corresponding structures in a case to enable the light bar to be removable and rotatable relative to the case while engaged with the corresponding structures; and a second fixing assembly disposed at a portion of the body between the opposing longitudinal ends;

wherein the light bar is affixable to an object external to the case via interaction of the second fixing assembly with the object when the first fixing assembly is disengaged from the corresponding structures in the case and the light bar is removed from the case.

2. The light bar of claim 1, wherein the light bar further comprises a multi-position switch disposed at a portion of the body, the multi-position switch defining at least an off position and two on positions corresponding to different light intensity settings.

3. The light bar of claim 1, wherein the second fixing assembly comprises a magnet disposed in the body to enable the body to be affixed to a metallic object.

4. The light bar of claim 1, wherein the corresponding structures in the case comprises holding slots, and wherein the first fixing assembly is configured to be removable from the holding slots and rotatable in the holding slots between selected ones of a plurality of predetermined light bar orientations.

5. The light bar of claim 4, wherein the first fixing assembly comprises a retention boss formed at each of the opposing longitudinal ends of the body, wherein the retention boss extends away from a base surface of the body, the retention boss further including an alignment slot formed therein, wherein the light bar is removable from or insertable into the holding slots based on alignment of the alignment slot and an alignment protrusion of one of the holding slots, and wherein the light bar is rotatable when retained in the holding slots.

6. The light bar of claim 5, wherein the base surface comprises a plurality of locking slots extending radially outwardly from the retention boss.

7. The light bar of claim 6, wherein the corresponding structures in the case further comprises a locking protrusion, wherein the locking protrusion is alignable with a selected one of the locking slots to insert the locking protrusion into the selected one of the locking slots to fix the light bar relative to the frame member.

8. The light bar of claim 7, wherein the holding slots each further comprise a collar portion disposed proximate to a locking protrusion and defining a receiving orifice, the locking protrusion and alignment protrusion being disposed on opposite sides of the receiving orifice, and wherein the retention boss is rotatable within the receiving orifice when neither the alignment slot nor any one of the locking slots engages a respective one of the alignment protrusion and the locking protrusion.

9. The light bar of claim 8, wherein a first locking slot is substantially aligned with the alignment slot, and the locking protrusion is aligned with the alignment protrusion such that the light bar is positionable to align both the first locking slot with the locking protrusion and the alignment slot with the alignment protrusion to enable installation and fixing of the light bar relative to the frame member.

10. The light bar of claim 8, wherein a second locking slot is disposed about 45 degrees away from the first locking slot in the base surface, the second locking slot being engageable with the locking protrusion to define a use position in which the light bar is fixed in an orientation in which a light window of the light bar faces substantially perpendicularly away from a base portion forming an outer wall of the case.

11. The light bar of claim 8, wherein a third locking slot is disposed about 135 degrees away from the first locking slot in the base surface, the third locking slot being engageable with the locking protrusion to define a storage position in which the light bar is fixed in an orientation in which a light window of the light bar faces substantially parallel to a base portion forming an outer wall of the case.

12. The light bar of claim 1, wherein the first fixing assembly and the second fixing assembly are integrated with and inseparable from the body of the light bar.

13. The light bar of claim 1, wherein the second fixing assembly affixes the light bar to an object external to the case independent of the first fixing assembly.

14. A case for storing drivable components, the case comprising:

a first half shell and a second half shell operably coupled to each other via a hinge;

a frame member configured to be retained in at least one of the first half shell or the second half shell; and a light bar comprising a battery operated lighting element, wherein the frame member comprises holding slots disposed in lateral sides of the frame member, and wherein the light bar is configured to be removable from or insertable into the holding slots, each holding slot comprising an alignment protrusion that aligns with an alignment slot at a respective longitudinal end of the light bar.

15. The case of claim 14, wherein the light bar comprises:

a body inside which the light element and the battery are housed; and a retention boss at each opposing end of the body, wherein the light bar is rotatable into a plurality of predetermined light bar orientations;

wherein the retention boss is configured to be received in the holding slots in a selected one of a locked state or a rotatable state, wherein the locked state fixes the light bar relative to the frame member in a selected one of the plurality of predetermined light bar orientations, and wherein the rotatable state enables the light bar to rotate about an axis of the light bar between selected ones of the plurality of predetermined light bar orientations.

16. The case of claim 14, wherein the light bar is rotatable into a plurality of predetermined light bar orientations;

wherein a selected one of the plurality of predetermined light bar orientations comprises a use position in which the light bar is fixed in an orientation in which a light window formed in the body faces substantially perpendicularly away from a base portion forming an outer wall of the case.

17. The case of claim 14, wherein the light bar is rotatable into a plurality of predetermined light bar orientations;

wherein a selected one of the plurality of predetermined light bar orientations comprises a storage position in which the light bar is fixed in an orientation in which a light window formed in the body faces substantially parallel to a base portion forming an outer wall of the case.

18. The case of claim 14, wherein the light bar is rotatable into a plurality of predetermined light bar orientations;

wherein a selected one of the plurality of predetermined light bar orientations comprises an install/remove position in which the light bar is fixed in an orientation in which a light window formed in the body faces about 45 degrees away from a base portion forming an outer wall of the case.

19. The case of claim 14, wherein the light bar is rotatable into a plurality of predetermined light bar orientations;

wherein the light bar is configured to be removable from the holding slots from a selected one of the plurality of predetermined light bar orientations, and is also insertable into the holding slots in the same one of the plurality of predetermined light bar orientations.

20. The case of claim 14, wherein the light bar further comprises a multi-position switch disposed at a portion of the body, the multi-position switch defining at least an off position and two on positions corresponding to different light intensity settings.

* * * * *